US006862763B2

(12) United States Patent
Mossbeck et al.

(10) Patent No.: US 6,862,763 B2
(45) Date of Patent: Mar. 8, 2005

(54) POCKETED BEDDING OR SEATING PRODUCT HAVING POCKETS OF DIFFERING HEIGHTS

(75) Inventors: Niels S. Mossbeck, Carthage, MO (US); Terry W. Moser, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 35 days.

(21) Appl. No.: 10/307,883

(22) Filed: Dec. 2, 2002

(65) Prior Publication Data

US 2004/0103479 A1 Jun. 3, 2004

(51) Int. Cl.[7] ..... A47C 16/00

(52) U.S. Cl. ..... 5/655.8; 5/720; 5/727; 29/91; 267/103; 267/142

(58) Field of Search ..... 5/655.8, 720, 727, 5/716; 29/91, 91.1; 267/103, 142, 93

(56) References Cited

U.S. PATENT DOCUMENTS

| | | | |
|---|---|---|---|
| 685,160 | A | 10/1901 | Marshall |
| 698,529 | A | 4/1902 | Marshall |
| 1,852,943 | A | 4/1932 | Swanson |
| 2,236,007 | A | 3/1941 | Oldham |
| 2,568,055 | A | 9/1951 | Clark |
| 2,715,435 | A | 8/1955 | Rymland |
| 3,082,438 | A | 3/1963 | Nachman, Jr. |
| 3,230,558 | A | 1/1966 | Duncan |
| 4,234,983 | A | 11/1980 | Stumpf |
| 4,234,984 | A | 11/1980 | Stumpf |
| 4,462,129 | A | 7/1984 | Brannock |
| 4,578,834 | A | 4/1986 | Stumpf |
| 4,679,266 | A | 7/1987 | Kraft |
| 4,854,023 | A | 8/1989 | Stumpf |
| 5,136,740 | A | 8/1992 | Kraft |
| 5,868,383 | A | 2/1999 | Codos |
| 6,101,697 | A | 8/2000 | Stumpf et al. |
| 6,122,787 | A | 9/2000 | Kao |
| 6,143,122 | A | 11/2000 | Mossbeck et al. |
| 6,170,807 | B1 | 1/2001 | Eto |
| 6,173,464 | B1 | 1/2001 | McCune |
| 6,353,952 | B1 | 3/2002 | Wells |
| 6,375,169 | B1 | 4/2002 | McCraw et al. |
| 6,397,418 | B1 | 6/2002 | Stjerna |
| 6,398,199 | B1 | 6/2002 | Barber |
| 6,540,214 | B2 | 4/2003 | Barber |
| 2003/0074736 | A1 | 4/2003 | Grothaus |
| 2003/0218285 | A1 | 11/2003 | Grothaus |
| 2004/0128773 | A1 * | 7/2004 | Barber ..... 5/716 |

FOREIGN PATENT DOCUMENTS

| | | |
|---|---|---|
| DE | 93 16 223.5 | 10/1993 |
| DE | 297 10 267 U1 | 9/1997 |
| DE | 40 31 651 A1 | 4/1998 |
| DE | 297 22 598 U1 | 4/1998 |
| FR | 2 697 420 | 5/1994 |
| WO | WO 91/10387 | 12/1990 |
| WO | WO 94/18116 | 8/1994 |
| WO | WO 2004/039215 | 5/2004 |

* cited by examiner

*Primary Examiner*—Alexander Grosz
(74) *Attorney, Agent, or Firm*—Wood, Herron & Evans, LLP

(57) ABSTRACT

A bedding or seating product comprising a spring assembly made up of a plurality of parallel strings of springs joined to each other. Each of the strings of springs comprises a row of interconnected pocketed coil springs. Selected pockets of fabric are shorter than adjacent pockets, so coil springs in the selected pockets are under a greater load than adjacent coil springs. In one preferred embodiment, every other pocket is under a greater load than the adjacent pockets, resulting in a checkerboard arrangement in at least one area of the product.

22 Claims, 4 Drawing Sheets

POCKETED BEDDING OR SEATING PRODUCT HAVING POCKETS OF DIFFERING HEIGHTS

FIELD OF THE INVENTION

This invention relates generally to spring assemblies for mattresses, cushions and other bedding or seating products and, more particularly, to a pocketed coil spring assembly and associated method of manufacturing such an assembly.

BACKGROUND OF THE INVENTION

A well known type of bedding or seating product comprises a spring assembly which includes a number of discrete coil springs, each of which is enclosed in a fabric pocket in a length of folded fabric material. Longitudinal axes of the coil springs are generally parallel with one another so that the top and bottom end turns of the coil springs define top and bottom faces of the spring assembly. A row of such pocketed springs is known in the industry as a string of pocketed springs. A bedding or seating product can be fabricated from such strings of pocketed springs by binding or adhering the individual rows or strings of pocketed springs together to form a spring assembly which may be padded and encased in an upholstered covering. U.S. Pat. No. 6,143,122, which is fully incorporated herein, discloses one such method of adhesively bonding strings of pocketed springs together to form a spring assembly.

This type of spring assembly is commonly referred to as a pocketed spring unit due to the fact that each spring is contained within an individual pocket of fabric material. The construction of strings of pocketed coil springs in each pocket is well known in the art and, for example, is disclosed in U.S. Pat. No. 4,439,977 which is hereby incorporated by reference in its entirety. The system disclosed in that patent includes a spring coiler which forms a coil spring which is subsequently compressed and inserted between the plies of folded pocketing fabric material. Other systems for manufacturing pocketed coil spring assemblies are disclosed in PCT Patent Application No. WO 94/18116 and U.S. Pat. No. 6,101,697, each of which are expressly incorporated herein by reference.

Pocketed spring assemblies are generally recognized to have a unique and particular luxurious feel to them and mattresses manufactured of such pocketed spring assemblies provide a feeling of softness without lacking spring resilience or support. Mattresses and similar articles constructed of pocketed spring assemblies are often considered a high-end type of product because of the added benefits and features of the pocketed coil springs. Mattresses and the like of this type can be more costly to manufacture and assemble as a result of the considerable amount of time and labor which is involved in their manufacture, together with the fact that the method of fabrication and assembly of such pocketed spring assemblies can be complicated, particularly in an automated process.

One particular aspect of pocketed spring assemblies and the associated mattresses or the like is that the resulting product may have a "hard" feel due to the fact that all of the coil springs are identical and compressed to the same degree in individual pockets. Usually, the firmness of such a product is uniform across the width and along the length of the product.

Additionally, while pocketed spring assemblies are desirably provide a combination of softness and support, the ability to economically posturize a spring assembly or mattress of pocketed spring coils has heretofore been difficult. Posturization provides multiple zones or sections of differing firmnesses within a product such as a mattress. For example, the middle regions of the mattress, which typically support a person's torso, often require a firmer more resilient support while other areas of the mattress which support the feet and head of a person require a softer feel.

One known method of posturizing a pocketed spring unit has been to incorporate springs made of different gauge wire into the strings of springs. For example, the springs incorporated into the strings of springs within certain sections or zones of the spring assembly are made of a larger gauge wire than the springs incorporated into the strings of springs of the other sections or zones of the spring assembly. U.S. Pat. No. 6,173,464 discloses this concept, albeit with continuous bands of springs as opposed to individual springs.

Therefore, there is a need for a pocketed spring assembly which has an initial soft feel but the firmness necessary to support heavy loads.

There is further a need for a posturized pocketed spring assembly and associated method of manufacture which offers the advantages of posturization of the spring assembly without the higher manufacturing costs, production difficulties and inefficiencies associated with known posturized pocketed spring assemblies.

SUMMARY OF THE INVENTION

The invention of this application which accomplishes these objectives comprises a pocketed bedding or seating product and associated method of manufacture. The bedding or seating product comprises a pocketed spring assembly, one or more pads and an upholstered covering surrounding the pocketed spring assembly and pads.

The pocketed spring assembly comprises a plurality of parallel strings of springs joined together. Each of the strings of springs comprises a row of interconnected pocketed coil springs. Each of the pocketed coil springs comprises a coil spring surrounded with a pocket of fabric, as is conventional. Each of the coil springs has an upper end turn, a lower end turn and a plurality of central convolutions between the end turns. Although coil springs are preferably used in the present invention, other types of springs may be used in accordance with the present invention.

Preferably, each string of springs is made of one piece of fabric folded and welded into a plurality of pockets, each of the pockets containing a coil spring. Opposed plies of fabric of the string of springs may be joined together by sewing, gluing or sonic welding, as known in the art. Adjacent pockets within a string of springs are separated by generally vertically oriented lines of attachment or seams of the opposed plies to each other. The height of the pocket is determined by the distance between the bottom of the pocket and one longitudinal segment of attachment or seam of the opposed plies to each other. Alternatively, the height of the pocket may be determined by the distance between top and bottom seams of the pocket.

In several preferred embodiments of the present invention, each string of springs has pockets of alternating heights along its length. In these strings of springs, every other one of the pockets of fabric is shorter than the adjacent pockets of fabric so that the springs in the shorter pockets are compressed more than the springs in the adjacent taller pockets. Preferably, the coil springs are identical although they may be different, i.e. have different physical characteristics.

The concept of the present invention may also be used to posturize a bedding or seating product, i.e., make certain regions or portions firmer than other areas or portions of the bedding or seating product. This is accomplished by grouping together multiple strings of springs having identical characteristics in one region of a bedding or seating product. The strings of springs of the other regions have different characteristics so as to impart different firmnesses to the different regions.

In one of these embodiments of the present invention, at least one portion of a string of springs has pockets of alternating heights. In others of these embodiments, the entire length of select strings of springs has pockets of alternating heights. In these portions of the strings of springs, every other one of the pockets of fabric is shorter than the adjacent pockets of fabric so that the springs in the shorter pockets are compressed more than the springs in the adjacent pockets. Again, the coil springs are preferably identical although they may be different in some regard.

The bedding or seating product typically has a longitudinal dimension and a transverse dimension, the longitudinal dimension being greater than the transverse dimension. However, the longitudinal dimension and transverse dimension may be identical in a square bedding or seating product. In the invention of the present application, the strings of springs may extend longitudinally or transversely, depending upon the desired effect.

Adjacent strings of springs of the bedding or seating product are preferably glued together but may be otherwise secured to each other. At least one border wire may extend around the perimeter of the pocketed spring assembly of the bedding or seating product and be secured to select outermost pocketed coil springs. A first or lower border may be secured to the lower end turns of the coil springs of the outermost strings. A second or upper border wire may be secured to the upper end turns of the coil springs of the outermost strings or, alternatively, either border wire may be secured to intermediate convolutions of the coil springs of the outermost strings of springs.

Due to every other coil spring or selected ones of the coil springs being compressed less than the coil springs immediately adjacent to it in at least one section of the pocketed spring assembly, at least one section of the pocketed spring assembly has a "soft" feel when a load is placed thereon. Once the taller pocketed coil springs are compressed to the level of the shorter pocketed coil springs, the pocketed spring assembly has a uniform firmness.

One method of manufacturing the pocketed spring assembly of the present invention comprises inserting at least one spring into each of the pockets of a string of springs. The pockets are then closed such that every other pocket or selected pockets within the string of springs is of a height less than the adjacent pockets in the string of springs. The strings of springs are then joined together to form the pocketed spring assembly and the pocketed spring assembly encased in an upholstered covering.

The method of manufacturing the posturized spring assembly of the present invention varies depending upon the desired posturization. However, in each of the applications of the present invention whenever pockets of differing heights are incorporated into a portion of a string of springs, that region or section of the pocketed spring assembly has an initial "soft" feel when a load is placed thereon.

In each of the embodiments of the present invention, incorporating pockets of different heights into at least a portion of at least several strings of springs results in a pocketed spring assembly after multiple strings of springs are joined to each other. Such a product may be made in accordance with a customer's needs and desires quickly and easily.

These and other objects and advantages of the present invention will be more readily apparent from the following drawings.

DETAILED DESCRIPTION

Figure 1:
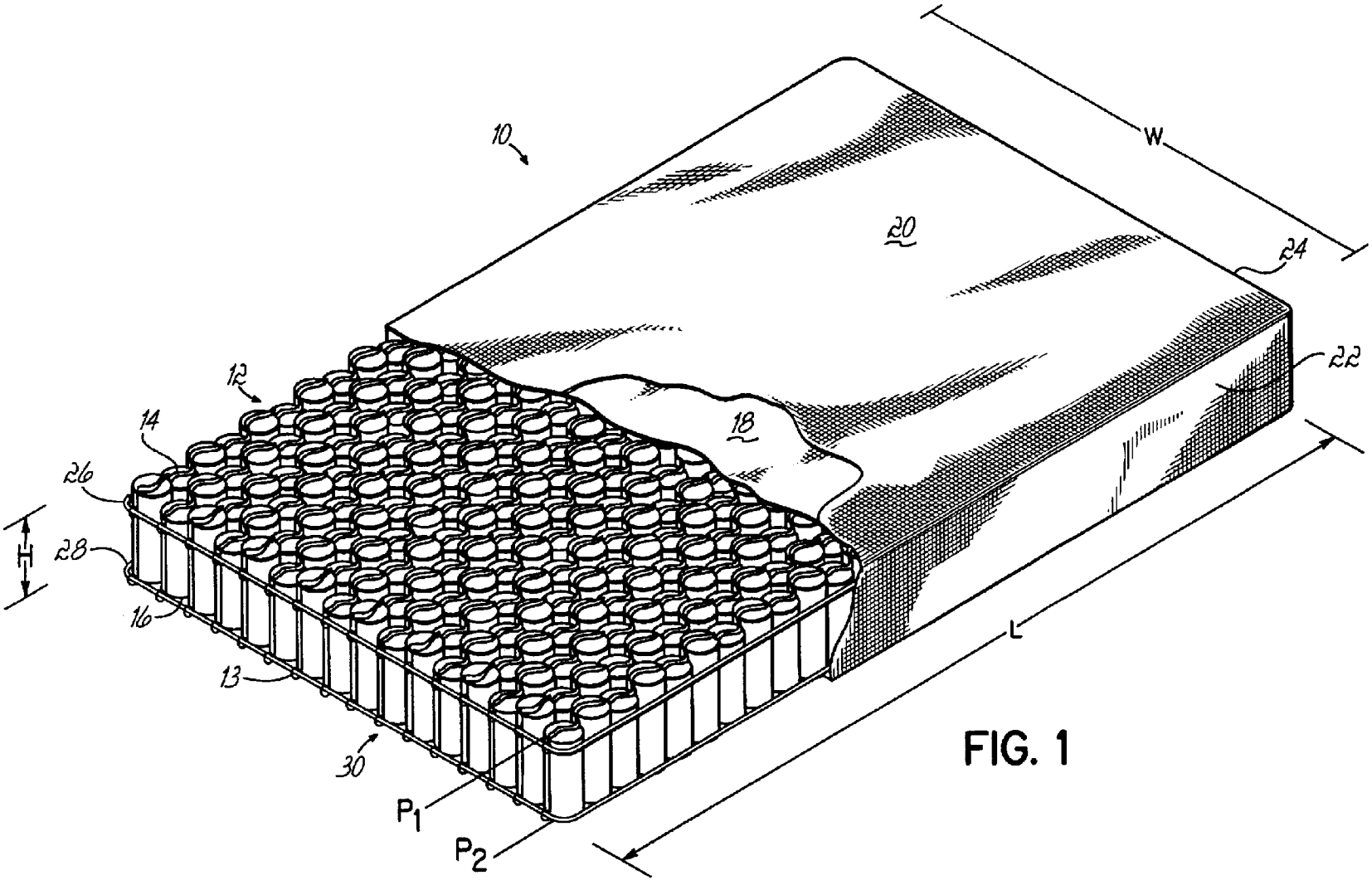
FIG. 1 is a perspective view of a bedding product made in accordance with the invention of this application comprising a pocketed spring assembly having a plurality of longitudinally extending strings of springs surrounded by generally rectangular border wires.

Referring to the drawings, and particularly to FIG. 1, there is illustrated a bedding or seating product in the form of a mattress 10. Although a mattress 10 is illustrated, the present invention may be used to construct any bedding or seating product. The mattress 10 comprises a pocketed spring assembly 12 having a generally planar top surface 14 in a top plane P1 and a parallel generally planar bottom surface 16 in a bottom plane P2. Covering pads 18 (only one being shown) may be located on the top and bottom surfaces 14, 16 of the pocketed spring assembly 12. An upholstered covering 20 encases the pocketed spring assembly 12 and the covering pads 18.

The mattress 10 has a height H defined as the distance between the top and bottom surfaces 14, 16 of the spring assembly 12. Similarly, the mattress 10 has a transverse dimension or width W defined between opposed side surfaces 22 and a longitudinal dimension or length L defined as the distance between the opposed end surfaces 24 of the mattress 10. The longitudinal dimension is illustrated as being larger than the transverse dimension of the mattress 10 although it is within the contemplation of the present invention that the longitudinal and transverse dimensions be identical, such as in a square product.

Figure 1A:
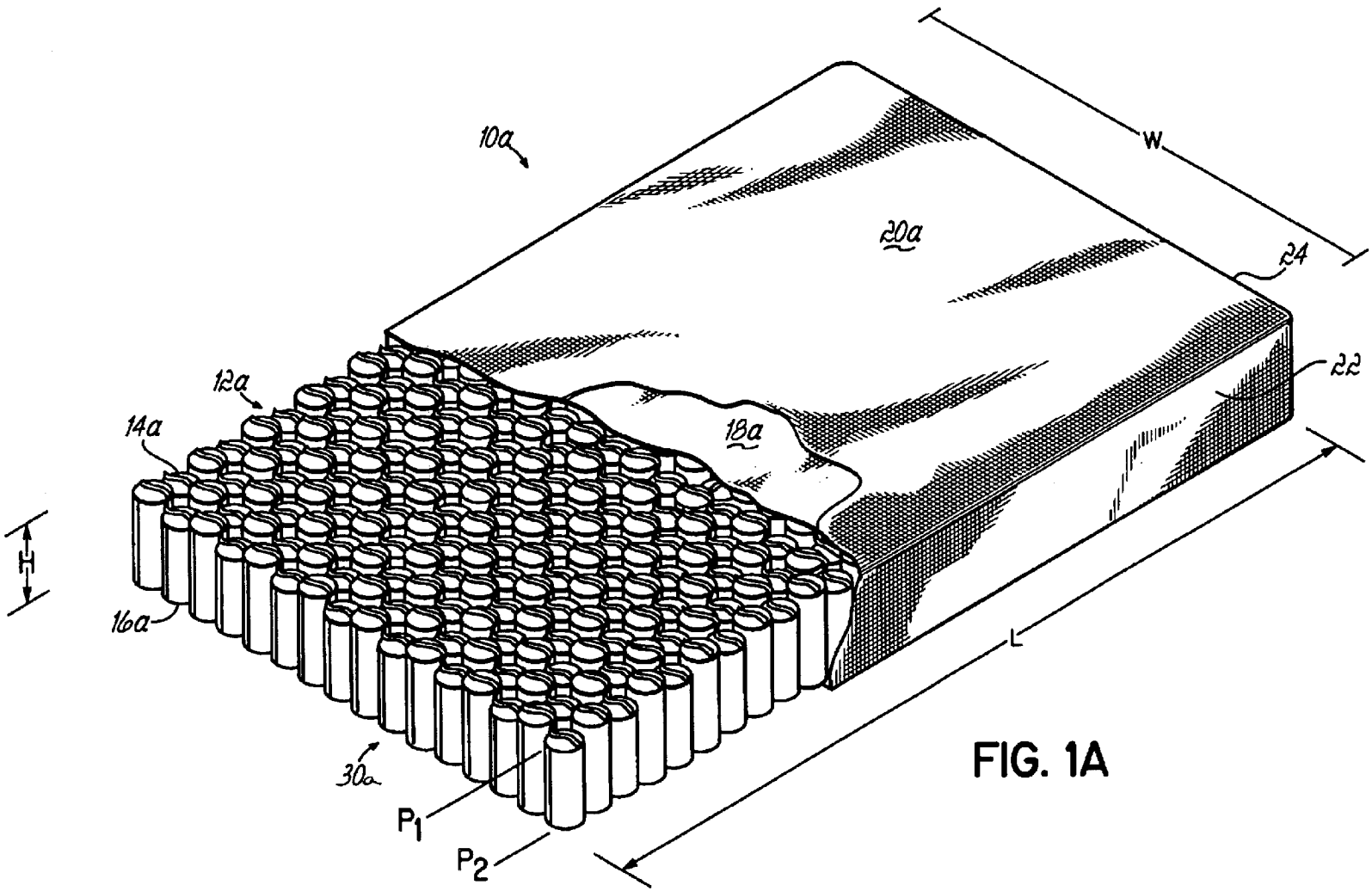
FIG. 1A is a perspective view of a bedding product made in accordance with the present invention, the strings of springs of the pocketed spring assembly extending transversely.

If desired, at least one border wire may be secured to the pocketed spring assembly 12 with hog rings or any other conventional fastener 13. FIG. 1 illustrates an upper border wire 26 and a lower border wire 28, both of which are generally rectangular, secured to the pocketed spring assembly 12. However, only one border wire may be used, if desired or none at all, as shown in FIG. 1A.

The pocketed spring assembly 12 comprises a plurality of longitudinally extending strings of springs 30 joined to each other. Adjacent strings of springs are preferably glued together as shown in U.S. Pat. No. 6,143,122, but may be joined to each other using any known technology.

Figure 2:
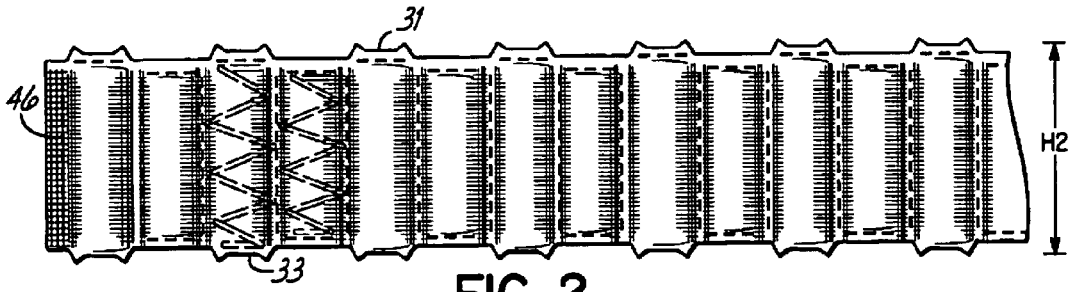
FIG. 2 is a side elevational view, partially broken away, of a string of springs made in accordance with the present invention.
Figure 3:
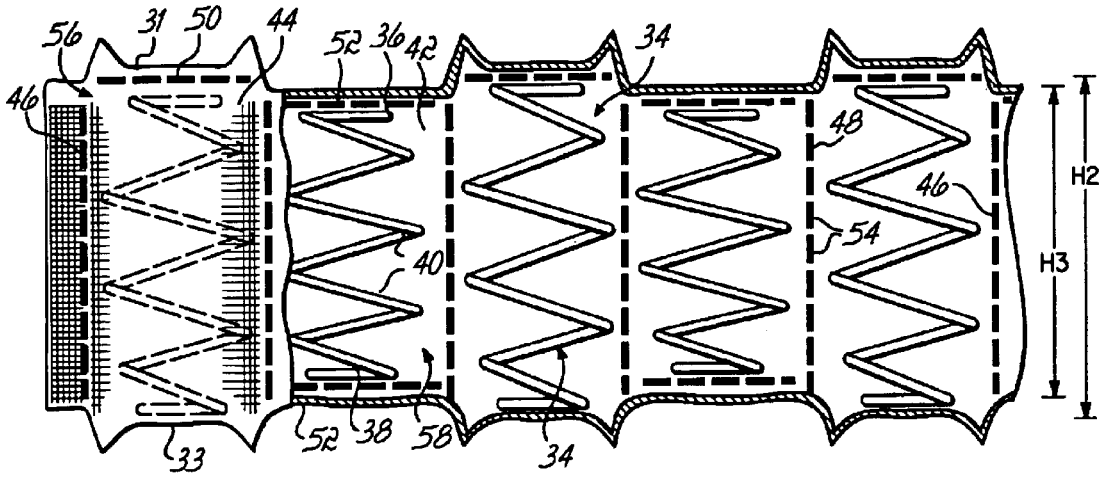
FIG. 3 is a side elevational view, partially cut away, of a portion of the string of springs of FIG. 2.

Referring to FIGS. 2 and 3, each string of springs 30 has a top surface 31 and a bottom surface 33, the distance between which defines the height H1 of the string of springs 30. Each string of springs 30 comprises a row of interconnected fabric pockets 32, each fabric pocket 32 containing a coil spring 34. As best illustrated in FIG. 3, each coil spring 34 has an upper end turn 36, a lower end turn 38 and a plurality of central convolutions 40 between the end turns 36, 38.

Preferably, only one piece of fabric is used to form a string of springs 30, the piece of fabric being folded over onto itself around the coil springs 34 to create a first ply 42 and a second ply 44. As illustrated in FIG. 3, the first ply 42 is behind the second ply 44. As is known in the art, opposite sides or plies of the fabric are sewn, welded or otherwise secured together in order to create a pair of outermost seams 46, a plurality of internal seams 48 and a plurality of longitudinal seams 50 and 52. The internal seams 48 separate adjacent pockets 32 and therefore adjacent coil springs 34. Although the seams 46, 48, 50 and 52 are illustrated as being a plurality of spaced, linear segments 54, they may comprise continuous lines or a series of dots or other arrangement without departing from the spirit of this application.

As best illustrated in FIG. 3, each string of springs 30 has alternating tall pockets 56 of a first height H2 and short pockets 58 of a second height H3 less than the first height H2. The height H2 of each of the tall pockets 56 is preferably substantially identical and defined by the distance between the bottom surface 33 of the string of springs 30 and one of the longitudinal seams 50. On the other hand, the height H3 of each of the short pockets 56 is preferably substantially identical and defined by the distance between the longitudinal seams 52 which are inwardly spaced from the top and bottom surfaces 31, 33, respectively of the string of springs 30.

Preferably, all of the coil springs 34 within a string of springs 30 are all the same height before being compressed and inserted into the pockets 32 of the strings of springs 30. Due to the difference in the heights of the short and tall pockets, 58, 56, respectively, the coil springs 34 located in the short pockets 58 are further compressed or loaded than are the coil springs 34 located in the tall pockets 56. For example, coil springs having an uncompressed height of eight inches might be compressed to a height of six inches in the tall pockets 56 and compressed to a height of four inches inside the short pockets 58.

The practical result of each of the strings of springs 30 being made of alternating tall and short pockets 56, 58, each pocket containing a coil spring is that the pocketed spring assembly 12 has a checkerboard pattern. Consequently, the mattress 10 has an initial "soft" feel when a load is placed thereon due to the coil springs 34 in the tall pockets 56 initially compressing before the coil springs 34 in the short pockets 58 are affected. For example, when a person initially lays on the mattress 10, the coil springs 34 in the tall pockets 56 compress a first distance to the height H2 of the coil springs 34 in the short pockets 58. Then, all of the coil springs 34 which are placed under a load regardless of which pocket they are in compress a second distance.

FIG. 1A illustrates an alternative embodiment of the present invention comprising a mattress 10*a*. The mattress 10*a* comprises a pocketed spring assembly 12*a* having a generally planar top surface 14*a* in a top plane P1 and a parallel generally planar bottom surface 16*a* in a bottom plane P2. Covering pads 18*a* (only one being shown) may be located on the top and bottom surfaces 14*a*, 16*a* of the pocketed spring assembly 12*a*. An upholstered covering 20*a* encases the pocketed spring assembly 12*a* and the covering pads 18*a*.

The pocketed spring assembly 12*a* comprises a plurality of transversely extending strings of springs 30*a* joined to each other. Adjacent strings of springs 30*a* are preferably glued together but may be joined to each other using any known technology. The strings of springs 30*a* are similar to those described above with regard to the embodiment shown in FIG. 1 and made in same manner. Like the embodiment of FIG. 1, this embodiment has a uniform composition or construction along its length and width.

Figure 4:
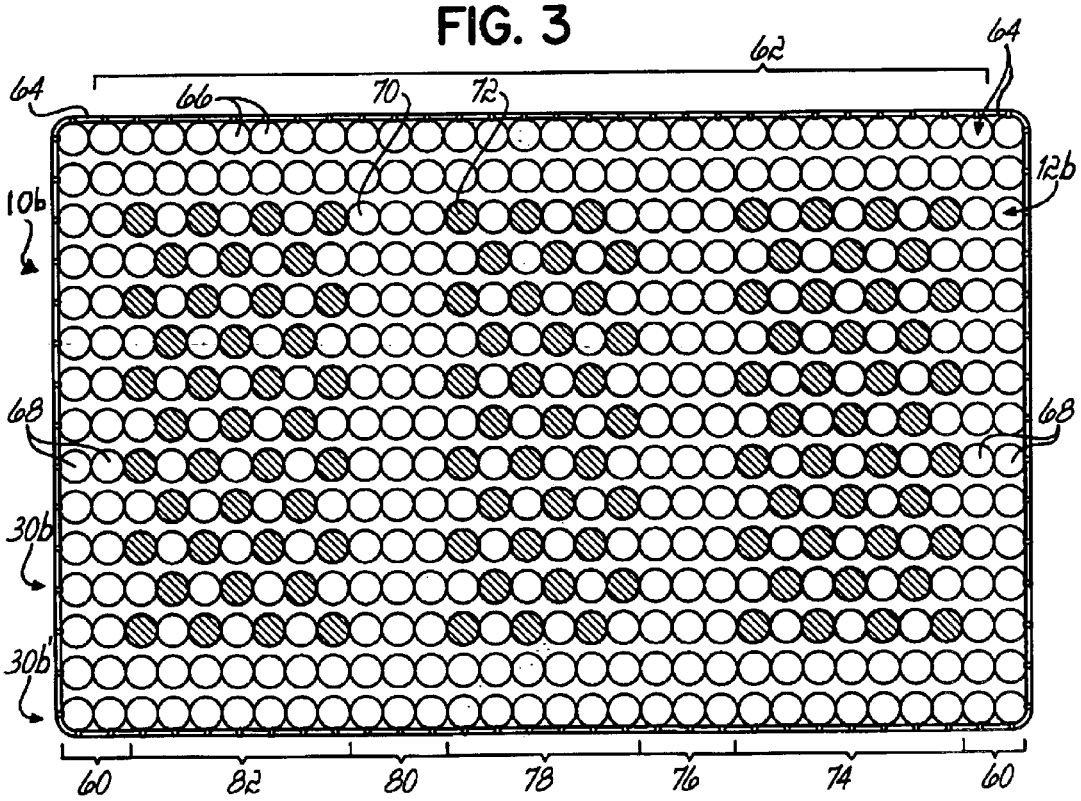
FIG. 4 is a top plan view of an alternative embodiment of pocketed spring assembly made in accordance with the present invention.

FIG. 4 illustrates an alternative embodiment of the present invention in which the mattress 10*b* is posturized, the mattress 10*b* having multiple regions of differing firmness. In this embodiment, the mattress 10*b* has a pocketed spring assembly 12*b* which is divided into multiple regions or sections as one moves longitudinally down the side of the mattress. At least one border wire 64 is secured to the pocketed spring assembly 12*b*. Around the perimeter of the mattress 10*b* is an edge portion 60 surrounding an internal portion 62. The edge portion 60 comprises two longitudinally extending strings of springs 30*b*' on each side of the mattress 10*b*. Each of these strings of springs 30*b*' has a uniform composition along its length because each of the pockets in each string of springs 30*b*' is the same height. In other words, each string of springs 30*b*' does not have alternating pockets of differing heights but rather all the pockets are tall pockets 66.

In this embodiment, the internal portion 62 of the pocketed spring assembly 12*b* is the posturized portion of the mattress 10*b*. The internal portion 62 of the pocketed spring assembly 12*b* comprises a plurality of longitudinally extending strings of springs 30*b* secured to each other in a known manner. The two pockets 68 at each end of each string of springs 30*b* are tall pockets and make up part of the edge portion 60 of the pocketed spring assembly 12*b*. The remaining pockets of each string of springs 30*b* between the outermost pockets 68 contain both tall and short pockets 70, 72, respectively in a manner as described below.

The internal portion 62 of the pocketed spring assembly 12*b* has a head section 74, immediately adjacent head section 74 is an upper lumbar section 76, immediately adjacent upper lumbar section 76 is center section 78, immediately adjacent center section 78 is a lower lumbar section 80 and at the other end of the internal portion 62 of the pocketed spring assembly 12*b* is a foot section 82.

The practical result of this configuration of pocketed spring assembly 12*b* is that the head section 74, center section 78 and foot section 82 have a checkerboard pattern which results in an initial "soft" feel when a load is placed thereon. The portions of each string of springs 30*b* in the head section 74, center section 78 and foot section 82 have alternating tall and short pockets 70, 72.

On the other hand, the portions of each string of springs 30*b* in the upper and lower lumbar sections 76, 80 contain only tall pockets 70. Therefore, the upper and lower lumbar sections 76, 80 have a "softer" firmness when compared to the head section 74, center section 78 and foot section 82.

Although the strings of springs 30*b* and 30*b*' are illustrated as being longitudinally extending, this embodiment of the present invention may also be accomplished with transversely extending strings of springs. If the strings of springs were transversely extending, each string of springs in the upper and lower lumbar sections 58, 62 would have only tall pockets and each string of springs in the head, center and foot sections 74, 78 and 82 would have alternating short and tall pockets, except the outermost pockets which form part of the edge portion.

Figure 5:
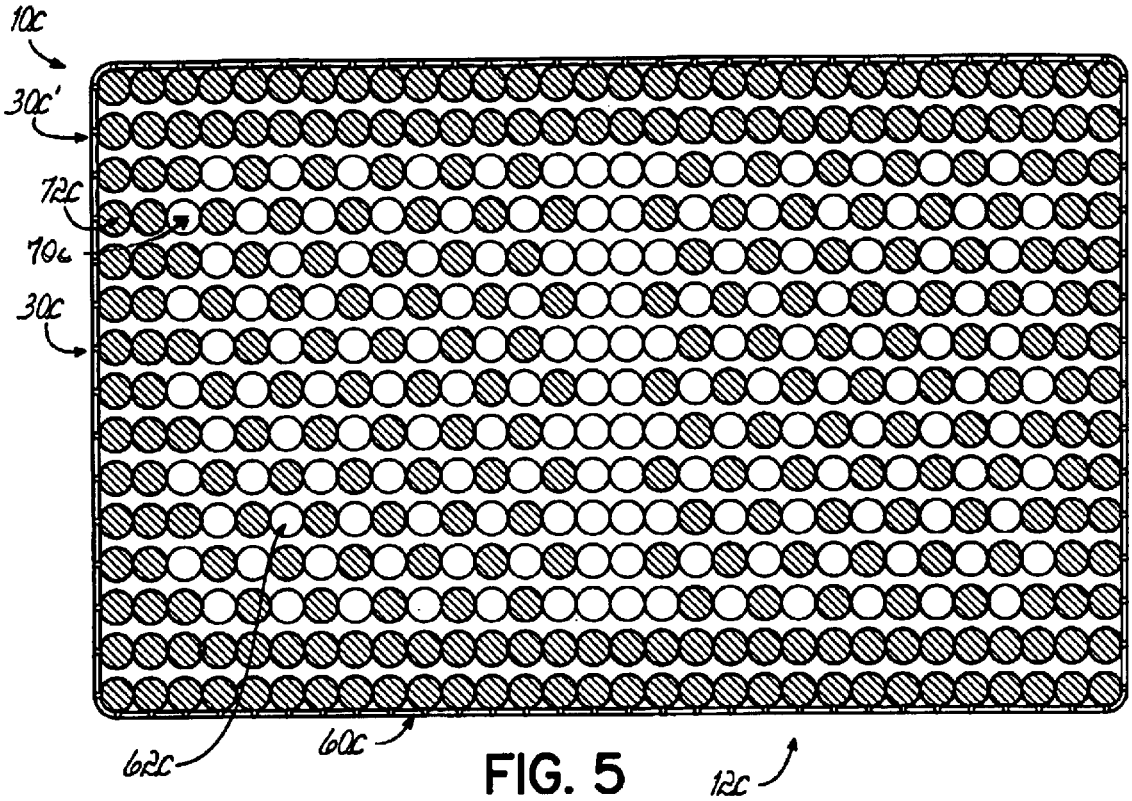
FIG. 5 is a top plan view of another alternative embodiment of pocketed spring assembly made in accordance with the present invention.

FIG. 5 illustrates an alternative embodiment of the present invention. In this embodiment, the mattress 10*c* has a pocketed spring assembly 12*c* comprising longitudinally extending strings of springs 30*c*, 30*c*' joined to each other in a conventional manner. The pocketed spring assembly 12*c* has an edge portion 60*c* around the perimeter of an internal portion 62*c*. The edge portion 60*c* comprises two longitudinally extending strings of springs 30*c*' on each side of the mattress 10*c*. Each of these strings of springs 30*c*' has a uniform composition along its length because each of the pockets in each string of springs 30*c*' is a short pocket having the same height. On the other hand, each string of springs 30*c* has two short pockets 72*c* at each end thereof and alternating pockets of differing heights therebetween. The short pockets 72*c* make up part of the edge portion 60*c* while the pockets therebetween alternate between short and tall pockets 72*c*, 70*c*, respectively.

Although the strings of springs 30*c*, 30*c*' are longitudinally extending, this embodiment of the present invention may also be manufactured with transversely extending strings of springs.

Although we have described several preferred embodiments of our invention, we do not intend to be limited except by the scope of the following claims.

We claim:

1. A bedding or seating product comprising:

a pocketed spring assembly comprising a plurality of parallel strings of springs, each of said strings of springs comprising a row of interconnected pocketed coil springs, each of said pocketed coil springs comprising a coil spring surrounded by a pocket of fabric, wherein within some of said strings of springs selected ones of said pockets of fabric are shorter than the other packets of fabric; and an upholstered covering surrounding said pocketed spring assembly.

2. A bedding or seating product comprising:

a pocketed spring assembly comprising a plurality of parallel strings of springs, each of said strings of springs comprising a row of interconnected pocketed coil springs, each of said pocketed coil springs comprising a coil spring surrounded by a pocket of fabric, wherein within some of said strings of springs selected ones of said pockets of fabric are shorter than the other pockets of fabric.

3. The bedding or seating product of claim 2 wherein within some of said strings of springs every other one of said pockets is shorter than the other pockets.

4. The bedding or seating product of claim 2 wherein all of said coil springs are identical.

5. The bedding or seating product of claim 2 wherein said product has a longitudinal dimension and a transverse dimension, said longitudinal dimension being greater than said transverse dimension, said strings of springs extending longitudinally.

6. The bedding or seating product of claim 2 wherein said product has a longitudinal dimension and a transverse dimension, said longitudinal dimension being greater than said transverse dimension, said strings of springs extending transversely.

7. The bedding or seating product of claim 2 wherein at least one border wire is secured to said pocketed spring assembly.

8. The bedding or seating product of claim 2 wherein adjacent strings of springs are glued together.

9. A bedding or seating product comprising:

a pocketed spring assembly comprising a plurality of parallel strings of springs joined to each other, each of said strings of springs comprising a row of interconnected pocketed springs, each of said pocketed springs comprising a spring surrounded by a pocket of fabric, wherein said pocketed spring assembly has multiple regions of differing firmness, at least one of said regions having pockets of differing heights.

10. The product of claim 9 wherein at least one of said regions has pockets of alternating heights.

11. The product of claim 9 wherein said strings of springs extend longitudinally.

12. The product of claim 9 wherein said strings of springs extend transversely.

13. The product of claim 9 further comprising at least one border wire surrounding said pocketed spring assembly.

14. A bedding or seating product comprising:

a pocketed spring assembly comprising a plurality of parallel strings of springs joined to each other, each of said strings of springs comprising a row of interconnected pocketed springs, each of said pocketed springs comprising a spring surrounded by a pocket of fabric, wherein said pocketed spring assembly has multiple regions of differing firmness, at least one of said regions having strings of springs in which the pockets of the strings of springs are different heights and the springs in said strings of springs are identical.

15. A bedding or seating product comprising:

a pocketed spring assembly comprising a plurality of parallel strings of springs, each of said strings of springs comprising a row of interconnected pocketed coil springs, each of said pocketed coil springs comprising a coil spring surrounded by a pocket of fabric, wherein within each of said strings of springs every other one of said pockets of fabric is of a first height and the other pockets of fabric are of a second height less than said first height.

16. A string of springs for inclusion in a bedding or seating product, said string of springs comprising a row of interconnected pocketed coil springs, each of said pocketed coil springs comprising a coil spring surrounded with a pocket of fabric, said string of springs having alternating pockets of different heights.

17. The string of springs of claim 16 wherein each of said coil springs is identical.

18. The string of springs of claim 16 wherein said string of springs is joined to other similar strings of springs by gluing strings of springs together to create a spring assembly.

19. A method of manufacturing a bedding or seating product comprising a spring assembly, said method comprising:

providing a string of springs having a plurality of pockets, inserting one spring into each pocket of said string of springs, closing all of said pockets of said string of springs such that fabric encases the spring in each of said pockets, selected pockets within said string of springs being of a height less than the other pockets in said string of springs, and joining said string of springs to adjacent strings of springs to form the spring assembly.

20. The method of claim 19 further comprising encasing the spring assembly in a fabric covering.

21. A method of manufacturing a bedding or seating product comprising a spring assembly made of a plurality of strings of springs joined to each other, each of said string of springs comprising a piece of fabric folded such that said piece of fabric has opposed plies on opposite sides of a row of springs, said opposed plies being joined together between adjacent springs in said string of springs to create a plurality of pockets, said method comprising:

inserting at least one spring into each pocket of a string of springs, closing all of said pockets of said string of springs such that fabric encases said at least one spring in each of said pockets, wherein every other pocket within said string of springs is a first height and every other pocket in said string of springs is a second height less than said first height, and joining said string of springs to adjacent strings of springs to form the spring assembly.

22. The method of claim 21 further comprising encasing the spring assembly in a fabric covering.

* * * * *

UNITED STATES PATENT AND TRADEMARK OFFICE

CERTIFICATE OF CORRECTION

PATENT NO. : 6,862,763 B2
DATED : March 8, 2005
INVENTOR(S) : Niels S. Mossbeck and Terry W. Moser It is certified that error appears in the above-identified patent and that said Letters Patent is hereby corrected as shown below:

Column 1,
Line 42, change “are” to -- is --.
Line 65, delete “are”.

Column 7,
Line 34, change “packets” ” to -- pockets --.

Signed and Sealed this

Sixteenth Day of August, 2005

JON W. DUDAS
*Director of the United States Patent and Trademark Office*